United States Patent [19]

Kreissig

[11] 4,411,202

[45] Oct. 25, 1983

[54] RAIL VEHICLE

[75] Inventor: Ernst F. Kreissig, Seuzach, Switzerland

[73] Assignee: Schweizerische Lokomitiv-und Maschinenfabrik, Winterthur, Switzerland

[21] Appl. No.: 166,098

[22] Filed: Jul. 7, 1980

[30] Foreign Application Priority Data

Jul. 11, 1979 [CH] Switzerland ..... 6454/79

[51] Int. Cl.[3] ..... B61F 3/04; B61F 5/02; B61F 5/50

[52] U.S. Cl. ..... 105/199 R; 105/136; 105/182 R; 105/200

[58] Field of Search ..... 105/133, 135, 136, 196, 105/199 F, 199 R, 200

[56] References Cited

U.S. PATENT DOCUMENTS

| | | | |
|---|---|---|---|
| 3,547,046 | 12/1970 | Lich | 105/199 R |
| 3,563,185 | 2/1971 | Wilmot et al. | 105/199 F |
| 3,576,166 | 4/1971 | Bollmann | 105/199 F X |
| 3,796,166 | 3/1974 | Wilmot | 105/199 R |
| 3,828,692 | 8/1974 | Kreissig | 105/135 X |
| 4,015,541 | 4/1977 | Roosen | 105/199 R |
| 4,040,360 | 8/1977 | Jackson | 105/199 R X |
| 4,233,910 | 11/1980 | Schumacher | 105/199 R X |

FOREIGN PATENT DOCUMENTS

| | | | |
|---|---|---|---|
| 266914 | 12/1978 | Austria | 105/199 F |
| 631354 | 11/1949 | United Kingdom | 105/199 R |

*Primary Examiner*—Robert B. Reeves
*Assistant Examiner*—Howard Beltran
*Attorney, Agent, or Firm*—Kenyon & Kenyon

[57] ABSTRACT

The rail vehicle has two bogies each connected to the vehicle body by way of a single rod adapted to transmit traction and braking forces. The rods are disposed in the longitudinal center-plane of the body and are articulated to the body at one end and to the particular bogie at the opposite end. The rods are at an inclination such that the imaginary extension of the longitudinal axis of each rod intersects the transverse center-plane of the particular bogie concerned at a distance below the plane of the rail-top surfaces. To an extent corresponding to the distance, the axle loading of the leading wheel set of the leading bogie becomes greater than the axle loading of the second wheel set, thus compensating for the effect of reduced friction between the leading wheel set and the rails in bad weather conditions.

4 Claims, 5 Drawing Figures

-1-
F
S
P
O
α
h
a
II
2
3
4
5
6
6'
7
8
9
10
11
12
13
14
15
16
17
31
32

1
2
3
4
6
6'
7
8
9
10
11
12
12a
15

RAIL VEHICLE

This invention relates to a rail vehicle. More particularly, this invention relates to a rail vehicle having means for transmitting traction and braking forces between a body and a pair of bogies.

Heretofore, it has been known to construct rail vehicles in a manner wherein a rail body is supported on a pair of bogies. In order to transmit traction and braking forces between the bogies and body it has been known to utilize various types of means. For example, it has been known to connect each of two bogies to a body, such as a locomotive body, by way of two pull or draw rods or bars which extend in opposite longitudinal directions to each other. Depending upon the direction of travel of the locomotive, each such rod transmits the tractive effort from the particular bogie concerned to the locomotive body or vice versa. Depending upon construction, the rods can be disposed either horizontally or at an angle to the plane of the top surfaces of the rails in which the vehicle rides. Generally, the inclination of the rods serves as a means to affect the distribution of wheel loading in the bogies.

It is also known, for example from U.S. Pat. No. 3,796,166 to use two rods between each bogie and a body with the rods arranged in longitudinal planes which extend equidistantly from and on both sides of the longitudinal center plane of the bogie. In this case, each rod is articulated to the body by way of a web which is secured to the body and to the bogie by way of a support plate which extends transversely in the center part of the bogie and which has a depending boss pivotally received in a central bore of a frame of the bogie. The inclination of the rods is such that the imaginary extensions of their axes intersect the transverse center plane of the associated bogie substantially in the plane of the top surfaces of the rails. This point is thus at the ideal position for the transmission of draft or traction forces.

Generally, the support plate of this construction is rotatably mounted in the bogie. However, this requires a relatively complicated and expensive construction particularly with respect to the articulation of the rods. Further, the vertical load acting on a bogie is distributed uniformly between the wheel sets of the bogie even when traction is applied. In similar fashion, the vertical load of the leading bogie and the corresponding increased load on the trailing bogie are distributed uniformly between the wheel sets of the bogie such that there is a risk of a lower adhesion of the leading axle of the leading bogie than of the trailing axle in the event of a reduced friction due, for example to wet rails or leaves on the rail. Consequently, under conditions in which friction is impaired, there may be a considerable reduction in the draft which can be transmitted and, therefore, in the acceleration which can be provided and/or the load which can be hauled on gradients.

Accordingly, it is an object of the invention to distribute the total vertical load acting on a leading bogie of a rail vehicle in a non-uniform manner between the axles of the bogie.

It is another object of the invention to provide a rail vehicle wherein the leading axle of a leading bogie is loaded considerably more than the trailing axle of the bogie when a draft is applied.

It is another object of the invention to improve the transmission of traction forces to the leading axle of a leading bogie during inclement weather conditions.

It is another object of the invention to provide a traction and braking means for a rail vehicle whereby the power delivered to a locomotive can be improved.

It is another object of the invention to provide a relatively simple means of transmitting traction and braking forces between a rail body and a pair of bogies on which the rail body is mounted.

It is another object of the invention to improve the adhesion forces between a leading axle which always encounters relatively poor friction conditions of a leading bogie and a rail surface.

Briefly, the invention provides a rail vehicle which is comprised of a body, a pair of bogies which support the body thereon with a pair of wheel sets in each bogie, and a pair of rods which are disposed symmetrically of the transverse center plane of the body for transmitting traction and braking forces between the bogies and the body. Each rod is angularly disposed in the longitudinal center plane of the body and has one end articulated to the body and an opposite end articulated to a respective one of the bogies. In addition, each rod has a longitudinal axis with an imaginary extension intersecting the transverse center plane of the respective bogie at a point below the wheel sets, i.e. below the top surface of the rails in which the wheel sets ride.

Positioning the point of intersection forming the theoretical draft transfer point below the plane of the top surfaces of the rails increases the loading of the leading axle of the leading bogie. As a result, there is a considerable improvement in the ability of this axle to transmit draft forces notwithstanding adverse weather adhesion conditions. The distance of the point from the plane of the top surfaces of the rails depends upon the friction conditions regarded as important for the construction and particularly on the requirements concerning the tractive effort to be transmitted to the rails and the load required to be hauled on gradients.

The construction also enables the rods (or drive links or the like) to be articulated to conventional and particularly strong components of a bogie. This permits the construction to be simple and economical.

Preferably, the imaginary extensions of the axes of the rods intersect each other on the transverse center plane of the vehicle body at a point near the center of gravity of the body. Since body pitching is most likely to occur around the center of gravity of the body, this characteristic precludes any transmission of body pitch to the bogies. This is of advantage for the longitudinal oscillatory behavior of the complete vehicle.

In one embodiment, each bogie is provided with a cross-member and a web secured to the cross-member. In this case, each rod is articulated to a respective web. This provides a very simple and reliable construction.

In another embodiment, the rail vehicle is provided with a drive unit which is mounted on each bogie for driving the wheel sets of the bogie. In this embodiment, each rod is articulated to the drive unit.

In still another embodiment, wherein each wheel set includes an axle, each rod is articulated to the axle of one of the wheel sets of a respective bogie.

The latter embodiments have the additional advantage that the rod can be relatively long with the articulation point being relatively low. Also, the bogie need not have a front cross-member or transom and can, therefore, be correspondingly lighter in weight.

These and other objects and advantages of the invention will become more apparent from the following detailed description taken in conjunction with the accompanying drawings in which.

Referring to the drawings, like reference characters have been used throughout in order to indicate like components.

Figure 1:
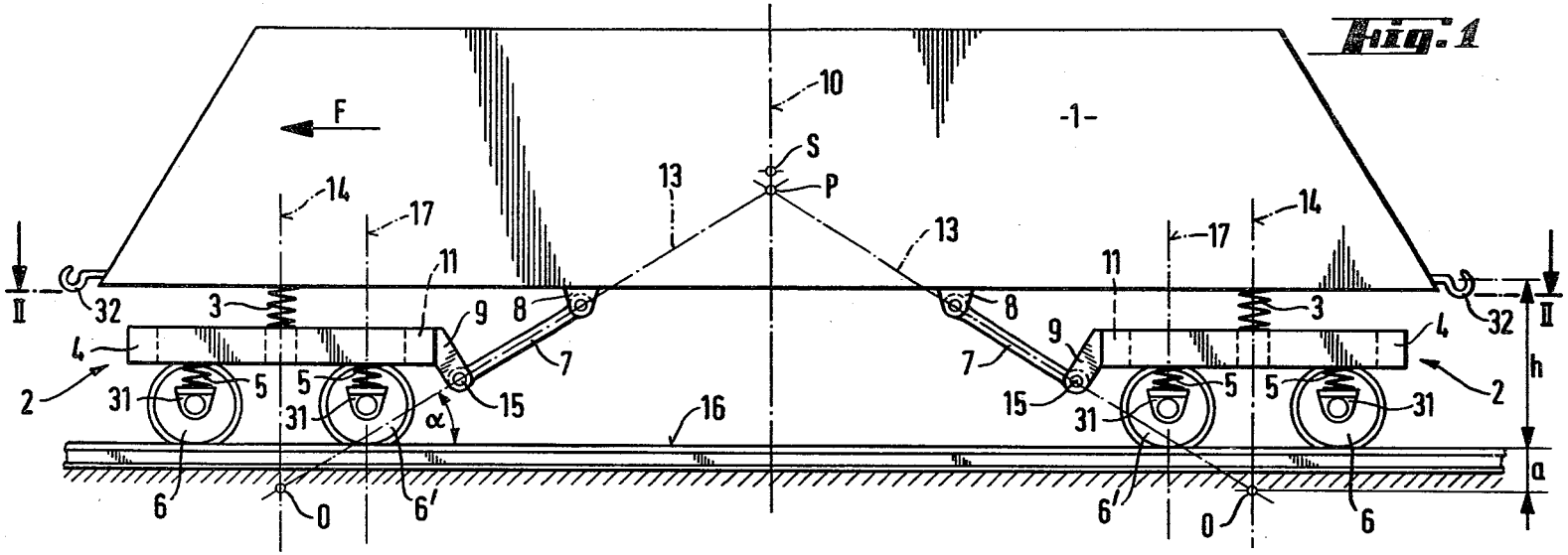
FIG. 1 illustrates a side elevational view of a rail vehicle constructed in accordance with the invention.
Figure 2:
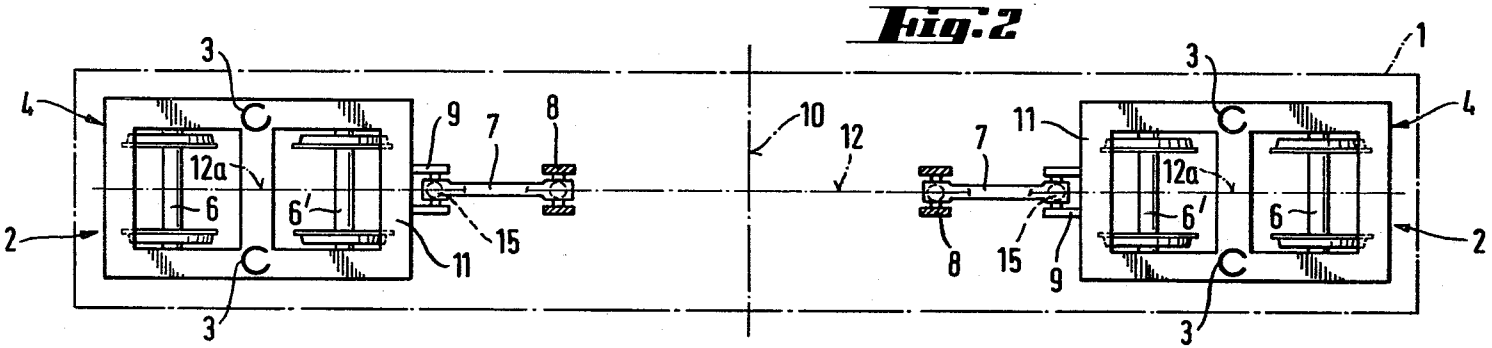
FIG. 2 illustrates a view taken on line II—II of FIG. 1.

Referring to FIGS. 1 and 2, the rail vehicle includes a body 1 which is mounted on a pair of bogies 2 via two pairs of secondary springs 3. Each bogie 2 has a frame 4 which is mounted by way of primary springs 5 on axle boxes 31 of two wheel sets 6, 6'. The axle boxes 31 are connected to the bogie frame 4 via means (not shown) for transmitting draft or traction, such as links or guide bosses or pins or the like. The wheel sets 6, 6' also have a drive unit (not shown) which is mounted in the bogie frame 4 in known manner.

A pair of rods 7 are disposed symmetrically of the transverse center plane of the body 1 for transmitting traction and braking forces between the bogies 2 and the body 1. The rods 7 may also be in the form of links or bars or the like. As shown, the rods 7 are angularly disposed in the longitudinal center plane of the body 1 at an angle $\alpha$ to a horizontal plane 16 determined by the top surfaces of a set of rails. In addition, each rod 7 is articulated for horizontal and vertical movement to a web or lug or the like 8 rigidly secured to the body 1 and articulated at the opposite end to a web or lug or the like 9 secured to a cross-member of transom 11 of the frame 4 of a bogie 2. As indicated, the transom 11 is the one closest to the transverse center plane 10 of the body 1. The webs 8, 9 are disposed in the longitudinal center plane 12, 12*a* of the body 1 and corresponding bogie 2, respectively.

Thus, each bogie 2 has a single rod 7 for transmitting draft and braking forces. Also, the points 15 where the rods 7 are pivoted to the webs 9 are disposed longitudinally between the transverse center plane 17 of the particular inner wheel set 6' and the transverse center plane 10 of the body 1. The angle of inclination $\alpha$ of the rods 7 is such that the imaginary extensions 13 of the longitudinal axes of the rods 7 intersect the transverse center plane 10 of the body 1 at a point P very near the center of gravity S of the body 1. As indicated, the point P is located on the transverse center plane 10. In addition, the imaginary extensions 13 of each rod 7 intersects the transverse center plane 14 of each bogie 2 at a point O disposed at a distance a which is appreciably below the wheel sets, i.e. below the plane 16 of the top surfaces of the rails.

Because the intersection point O is below the plane 16, the leading axle of the leading bogie is more heavily loaded than the trailing axle. Thus, the total vertical load acting on the leading bogie is distributed non-uniformly between the wheel sets of the bogie. Thus, when a draft is applied, the leading axle of the leading bogie is loaded considerably more than the trailing axle. This improves the adhesion effect particularly during inclement weather conditions. As a result, the ability of the leading axle to transmit adhesion forces in inclement weather conditions is improved.

Placing the point P near the center of gravity S of the body 1 obviates the transmission of body pitch to the bogies 2. This improves the longitudinal oscillatory behavior of the complete vehicle.

As shown in FIG. 1, couplers 32 or the like are disposed at both ends of the body 1 at a height h above the plane 16.

Figure 3:
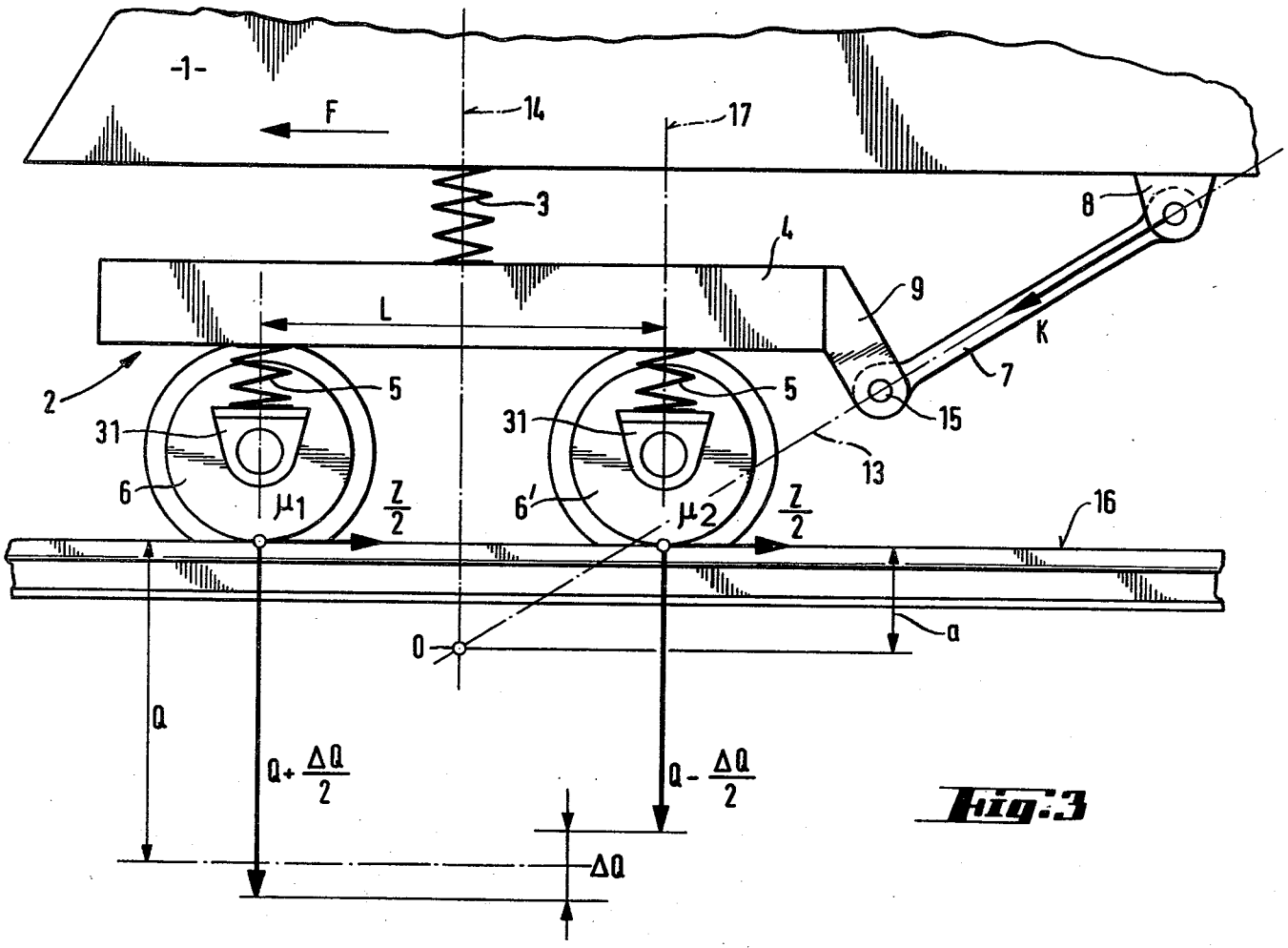
FIG. 3 illustrates a side view of a detail of FIG. 1 to an enlarged scale and schematically illustrates the forces which the bogie applies to the body and a set of rails.

The vertical distance a of the point O below the plane 16 i.e. below the wheel sets 6, 6' can be calculated in the light of the friction conditions operative in the weather conditions of interest. In this connection, FIG. 3 schematically shows the forces which need to be considered and which a bogie 2 leading in the direction of travel F applies to the body 1 and the rails. The draft of traction K applied to the body 1 is received ideally at the point O disposed at the distance a below the plane 16. The bogie therefore experiences a forward pitching moment, the leading wheel set 6 being more heavily loaded than the trailing set 6'. Assuming that the wheel sets 6, 6' experience different friction conditions, denoted by different coefficients of friction $\mu 1$, $\mu 2$, but the same draft components Z/2, the corresponding axle loadings are:

$$Q + \frac{\Delta Q}{2} \text{ and } Q - \frac{\Delta Q}{2},$$

Q denoting half of the average axle loading on the whole bogie 2 and being known from conventional calculations. $\Delta$ Q can be found from the equality condition of the draft components in the two wheels sets, i.e., from:

$$\frac{Z}{2} = \mu 1 \cdot \left(Q + \frac{\Delta Q}{2}\right) = \mu 2 \cdot \left(Q - \frac{\Delta Q}{2}\right)$$

The torque equation relative to the point O is as follows:

$$Za = \frac{\Delta QL}{2},$$

L denoting the distance between the wheel sets 6 and 6'. The value a can be calculated from this as follows:

$$a = \frac{\Delta Q}{2Z} \times L$$

For a locomotive having the following assumed date:

| | | |
|---|---|---|
| Total weight of locomotive | 80 | tons |
| Total draft to be transmitted, 2Z | 28 | Mp |
| Distance L between wheel sets | 2.5 | meters |
| Between-bogies distance | 7 | meters |
| Coupler height h | 1 | meter |
| Distance a | 0.1 | meter |

Calculations using these relationships lead to the following values:

$$\frac{\Delta Q}{2} = 0.56;\ Q = 18\ \text{Mp}$$

$$\frac{Q + \frac{\Delta Q}{2}}{Q - \frac{\Delta Q}{2}} = \frac{18.56\ \text{Mp}}{17.44\ \text{Mp}} = 1.06 = \frac{\mu_2}{\mu_1}$$

In other words, if the coefficient of friction $\mu_2$ of the trailing wheel set 6' is 6% greater than the coefficient of friction $\mu_1$ of the leading wheel set 6 of the leading bogie 2, shifting the point O by the distance a=0.1 meters below the plane 16 equalizes the drafts transmitted by the two wheel sets 6, 6'. An estimated minimum value for a of 0.05 meters, corresponding to 2% of the between-wheel sets distance L, is assumed to be necessary for the characteristic to have any appreciable effect. The $\mu_2/\mu_1$ ratio which this step can compensate for is 1.03.

Figure 4:
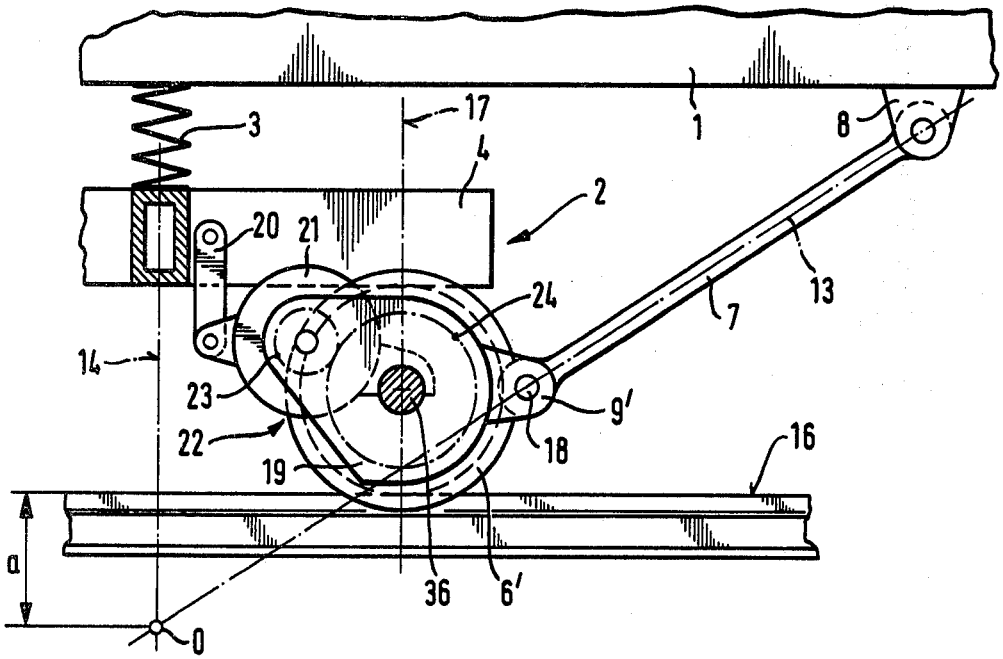
FIG. 4 illustrates a modified rail vehicle construction in accordance with the invention.

Referring to FIG. 4, the bogie end of the rods 7 can be pivotally connected to a drive unit which is fixedly or movingly mounted in the bogie frame 4 for driving the wheel sets 6, 6'. As shown, the drive unit is coupled with the wheel set 6' and comprises an axle-hung motor 21 carried on an axle 36 of the wheel set 6' and a gearbox 22 having gears 23, 24. The gearbox 22 is received in a casing 19 mounted on the axle 36. The motor 21 is pivotally connected by way of a torsion bar 20 to a longitudinal member of the bogie frame 4 which frame 4 has no front transom.

In this embodiment, the bogie end of the rod 7 is pivoted by way of a low-level pin 18 to a web or lug or like 9' secured to the casing 19—i.e., to a component of the drive unit which is movable relative to the bogie frame 4. In the absence of a front transom, for instance, the bogie frame 4 can be of lighter construction. Also, the rod 7 pivoted to the casing 18 can be longer than if directly pivoted to the bogie frame 4. This is advantageous for the mobility of the connection between the bogie frame 4 and the vehicle body 1.

In this construction, the pivot point, i.e., the pin 18 is disposed somewhere between the transverse center-plane 17 of the wheel set 6' and the body transverse center-plane 10 (not visible in FIG. 4). However, the pivot point could be disposed somewhere between the transverse center-plane 17 of the wheel set 6' and the transverse center-plane 14 of the bogie 2. Similarly, the rod 7 could be articulated to some other part of the drive unit, e.g. the motor 21.

Figure 5:
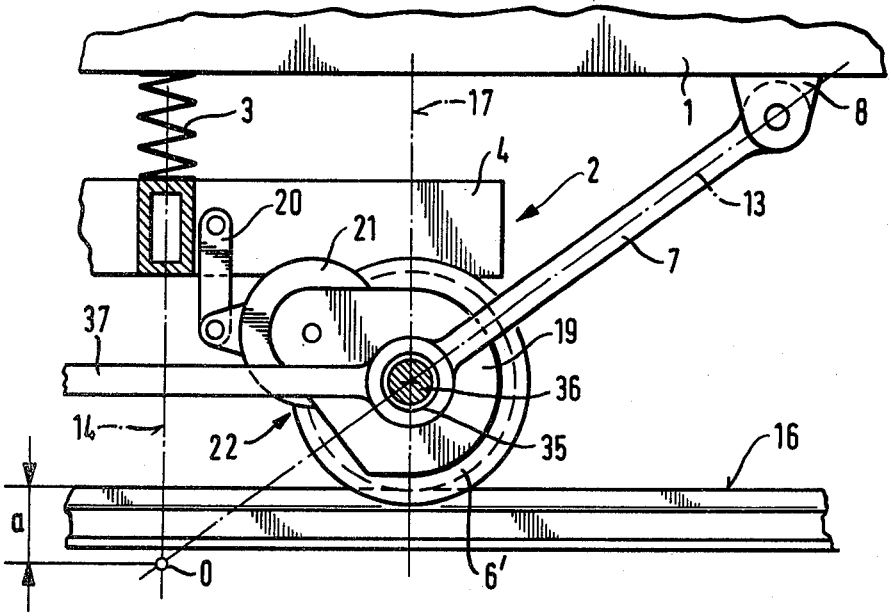
FIG. 5 illustrates a further embodiment of a rail vehicle according to the invention.

Referring to FIG. 5, the bogie end of the rod 7 can alternatively be directly pivoted to the axle 36 of the wheel set 6' by way of a self-aligning bearing 35. The axle 36 is, in turn, connected, by way of a rod or the like 37 adapted to transmit traction and braking forces, to the axle (not shown in FIG. 5) of the trailing wheel set of the same bogie 2.

I claim:

1. A rail vehicle comprising a body having a longitudinal center plane, a transverse center plane, and a center of gravity on said transverse center plane;

a pair of bogies supporting said body thereon, each said bogie having a pair of wheel sets thereon; and a pair of rods disposed symmetrically of said transverse center plane for transmitting traction and braking forces between said bogies and said body, each said rod being angularly disposed in said longitudinal center plane and having one end articulated to said body and an opposite end articulated to a respective one of said bogies, each said rod having a longitudinal axis with an imaginary extension intersecting a transverse center plane of said respective bogie at a point below said wheel sets to impart a forward pitching moment on said leading bogie and thereby increase the loading of the leading axle of the leading bogie relative to the direction of movement of the vehicle and wherein said longitudinal axes of said inclined rods intersect said transverse center plane of said body at a point near said center of gravity to preclude transmission of a body pitch to said bogies.

2. A rail vehicle as set forth in claim 1 wherein each bogie has a cross-member and a web secured to said cross-member and each respective rod is articulated to said web.

3. A rail vehicle as set forth in claim 1 which further comprises a drive unit mounted on each respective bogie for driving said wheel sets and each respective rod is articulated to said drive unit.

4. A rail vehicle comprising a body having a longitudinal center plane, a transverse center plane, and a center of gravity on said transverse center plane;

a pair of bogies supporting said body thereon, each said bogie having a pair of wheel sets with each wheel set including an axle; and a pair of rods disposed symmetrically of said transverse center plane for transmitting traction and braking forces between said bogies and said body, each said rod being angularly disposed in said longitudinal center plane and having one end articulated to said body and an opposite end articulated to an axle of a respective one of said bogies, each said rod having a longitudinal axis with an imaginary extension intersecting a transverse center plane of said respective bogie at a point below said wheel sets with said longitudinal axes of said inclined rods intersecting said transverse center plane of said body at a point near said center of gravity.

* * * * *